United States Patent [19]

Von Gunten

[11] 4,191,084

[45] Mar. 4, 1980

[54] AUTOMATIC TRACKING APPARATUS

[76] Inventor: Lee Von Gunten, 1515 Crabtree, Arlington Heights, Ill. 60004

[21] Appl. No.: 962,861

[22] Filed: Nov. 22, 1978

[51] Int. Cl.[2] ..... G10F 5/06

[52] U.S. Cl. ..... 84/136; 84/138; 84/140; 84/60

[58] Field of Search ..... 84/136–140, 84/48–60; 235/200 WB; 226/10

[56] References Cited

U.S. PATENT DOCUMENTS

| | | | |
|---|---|---|---|
| 868,386 | 10/1907 | Ackerman et al. | 84/48 |
| 872,315 | 11/1907 | Wood | 84/140 |
| 1,098,890 | 6/1914 | Dickinson | 84/139 |
| 1,197,596 | 9/1916 | Betz | 84/60 |
| 1,207,965 | 12/1916 | Maier | 84/136 |
| 1,509,765 | 9/1924 | Nicholson | 84/140 |
| 3,585,895 | 6/1977 | Cannon | 84/137 |

*Primary Examiner*—L. T. Hix
*Assistant Examiner*—Benjamin R. Fuller
*Attorney, Agent, or Firm*—Grauer, Bianchi & White

[57] ABSTRACT

An automatic tracking apparatus is provided for maintaining alignment of music rolls in player organs and player pianos using an improved, air pressure controlled, sensing and control device. More particularly this system incorporates an air pressure sensing device utilizing a piston/cam controlled pendulum to operate a pneumatic alignment device.

8 Claims, 8 Drawing Figures

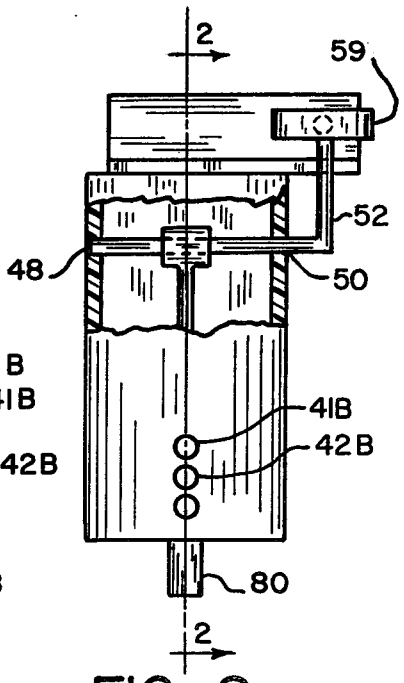
FIG-4
FIG-2
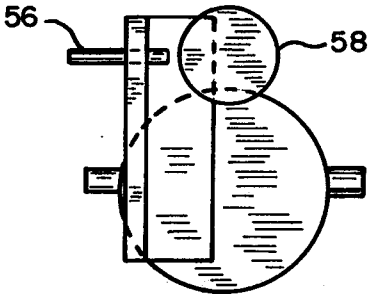
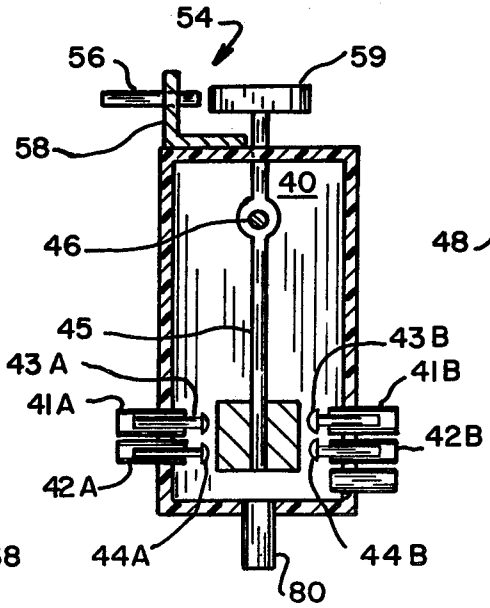
FIG-3
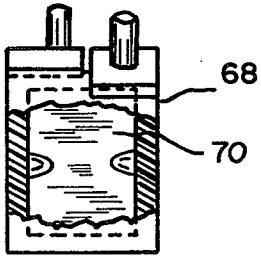
FIG-5
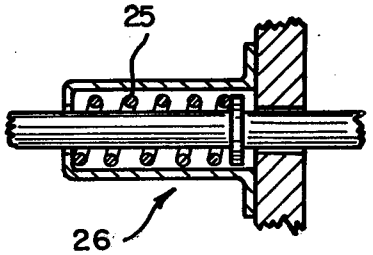
FIG-8
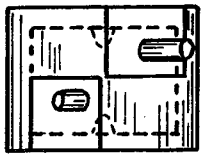
FIG-7
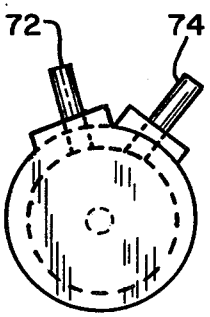
FIG-6

AUTOMATIC TRACKING APPARATUS

BACKGROUND OF THE INVENTION

This invention relates generally to automatic tracking systems for use with automatic music playing machines. Specifically this invention relates to a pneumatic system for automatically centering the music roll of perforated paper and maintaining it in alignment with sensors located on the customary tracker bar. Prior methods of maintaining this alignment were bulky and complex requiring multiple sensing devices. This necessitated multiple pressure actuated pneumatic devices and linkage connected to each of the alignment sensors. A change in pressure or air flow over the alignment sensor caused the corresponding pheumatic drive to operate mechanical linkage arranged to position the feed roller. The drawbacks to these systems were generally their size and complexity.

SUMMARY OF THE INVENTION

Accordingly, it is a primary object of this invention to provide a simplified sensing and control mechanism for positioning the feeder rolls. It is a further object to provide a single compact sensing and control device for use in the system which is responsive to multiple pressure signals from the tracker bar.

Other objects and advantages of the invention will become apparent upon reading the following detailed description and upon reference to the drawings. In summary, there is provided an automatic tracking and aligning apparatus for maintaining the alignment of perforated music rolls. The present invention incorporates a compact single chamber sensing and control device whereby misalignment of the feed roller and the perforated sheet generates a change in air flow in the chamber of the sensing and control device which in turn controls a single spring biased alignment pneumatic.

BRIEF DESCRIPTION OF THE DRAWINGS

FIG. 2 is a partially cut away view of the sensing and control device of FIG. 1.

FIG. 3 is a cross sectional view of FIG. 2 taken along lines 2—2.

FIG. 4 is a top view of the control valve of FIGS. 2 and 3.

FIG. 5 is a partially cut away view of the fluid cleaner of FIG. 1.

FIG. 6 is a side view of the fluid line cleaner of FIG. 5.

FIG. 7 is a top view of the fluid line of FIGS. 5 and 6.

FIG. 8 is a cut away view of the spring bias on the feed roller in the alignment system of FIG. 1.

Figure 1:
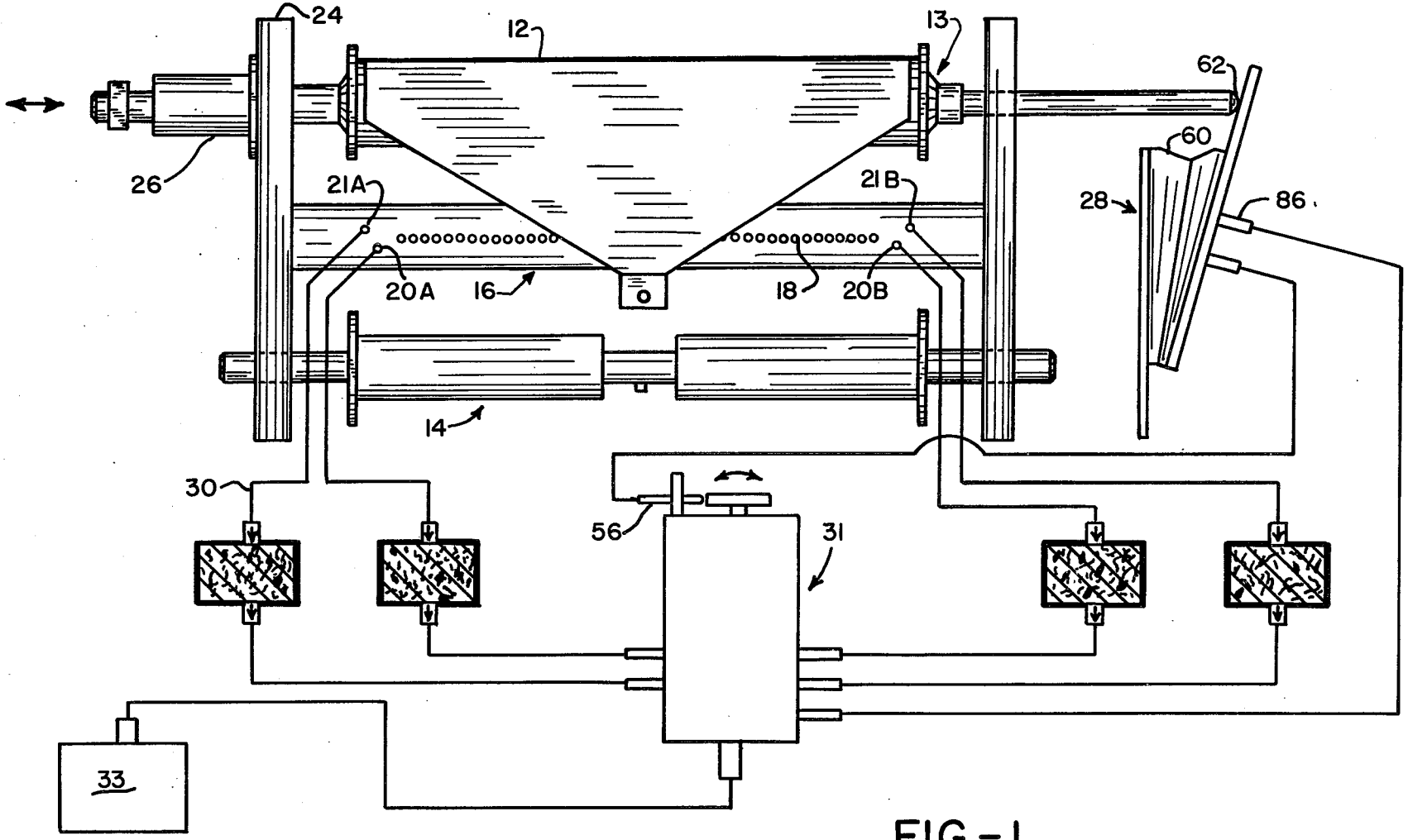
FIG. 1 is a diagramatic view of the alignment system of the subject invention.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Turning first to FIG. 1, there shown the automatic alignment system of the present invention for use in maintaining the alignment of a feed roll. Typically, this roll contains perforated sheet which is used to generate signals for operating a player piano or organ. For operation this roll of perforated paper 12 is shown suspended in fixed relationship to a take up roll 14 and arranged to feed the perforated paper across the tracker bar 16. The tracker bar commonly has spaced holes 18 arranged across its surface to sense the presence of the perforations by use of a vacuum draw maintained on the holes. The presence or absence of a perforation in the perforated paper is sensed by the change in pressure or air flow at the hole in the tracker bar. Similarly, outer edge sensing holes 20A, 20B, and 21A, 21B are provided on the outer edges of the tracker bar to sense the location of the edge of the perforated paper as it is fed across the bar. These holes are provided with a vacuum draw to create an air flow therethrough for sensing the edges of the perforated paper, as more fully described below.

More particularly, there is shown in FIG. 1 a feed roller 13 mounted for reciprocal lateral motion within the base framework 24. A spring bias 25 is provided in the roll mounting apparatus 26 (FIG. 8) to facilitate removal of the music roll and to provide a returning force against the alignment pneumatic 28.

In the preferred embodiment the edge sensing holes, located at the outer edges of the customary intermediate tracker bar, are arranged in a manner to provide a set of inner and outer holes. Normally, the inner set of holes 20A and 20B sense small deviations from alignment while the outer holes 21A and 21B sense gross deviations, however oversized sheets may also be used on this arrangement whereby the sheet may cover the inner holes entirely during operation as described more fully below.

The partial vacuum for creating the air flow is connected to the alignment sensing holes through tubular connectors 30 from the sensing and control device 31 which has a constant vacuum source 33. As a result the covering of a sensing hole by a misaligned edge of the music sheet interrupts the air flow into the sensing hole and reduces air flow through the connectors to the sensing and control device.

The sensing and control device 31 (FIGS. 2, 3 and 4) is designed to sense the interrupted air flow at the edge sensing holes and provide in response thereto a controlling pressure or air flow to the positioning bellows or pneumatic. Referring now to FIG. 3, there is shown a preferred embodiment of the control device of the present invention comprising an enclosed chamber 40 having multiple sensing ports 41A, 41B and 42A, 42B about the chamber. These ports are provided with smooth cylinders enclosing upper pistons 42A, 42B and lower pistons 44A, 44B, in loose fitting contact therewith. This arrangement allows limted air flow through the cylinder and displaces the piston in the direction of the air flow.

Suspended between the pistons is a pendulum member 45 arranged for free pivotal motion and depending from the upper extremity of the control device on the transverse cross bar 46. This pendulum has affixed to it's lower extremity a light weight rigid material such as wood or plastic to provide a working surface against which the pistons operate. A limited cross section and light weight is provided to minimize it's inertia for quicker response. In the preferred embodiment the pendulum is fixedly mounted on a transverse cross bar 46 arranged for rotation about it's longitudinal axis at it's contacts with the chamber wall 48 and 50.

Projecting through the chamber to provide control to the alignment pneumatic is an extension 52 of the transverse bar. This control is provided through the operation of the vent valve 54 which comprises a stiff cylindrical port 56 affixed by a mounting bracket 58 to the exterior wall of the chamber. A stopper member 59 is provided to control the air flow at the port. In the preferred embodiment, this stopper would comprise a deformable disc shaped member such as synthetic rubber with a cross section slightly larger than the port. The air flow is reduced when the extension 52 forces the stopper near the port and ultimately closes the port completely as the stopper is deformed against the opening.

The operation of the alignment pneumatic in the preferred embodiment is provided through the control of a vacuum draw on the bellows 28. This bellows is contracted by imposing on it a vacuum draw sufficient to evacuate the bellows and allow it to collapse unless vented to the atmosphere through the controlled valve 54. When air flows uninterrupted through the vent port 56 into the bellows the partial vacuum imposed on the bellows will be prevented from evacuating the collapsible section 60. However, when the flow of air from the atmosphere is reduced, air is drawn from the bellows 60 and it begins to contract. Finally, as air flow resumes through the vent valve, air fills the collapsible section 60 and it returns to it's expanded state.

The operation of the vent valve, accordingly, depends upon the responsive motion of the control arm 44. The position of the control arm is maintained by the pistons 41A, 41B and 42A, 42B in the sensing and control device and controls the air flow through the vent port 56 into the bellows. In response to this restriction of air flow, the alignment bellows constricts against the roller at their abutting surfaces 62 to force the feed roller into alignment. Likewise, sheet fed over the tracker bar is shifted into alignment by the movement of the feed roller. Movement of the pendulum in the opposite direction repoens the vent and allows air flow to increase and the bellows to return to it's expanded state. This return movement is assisted through the spring bias mechanism on the opposing end 26 of the feed roller.

Inasmuch as fluidic systems of these types are sensitive to particles and debris in the air, there is provided in the fluidic system of the preferred embodiment an air cleaner for removing debris prior to entry into the sensing and control device. Reference now being made to FIGS. 5, 6 and 7 there is shown an air cleaner having a cylindrical casing with a cylindrical chamber defined therein. The size of this chamber is maintained small enough to avoid loss of sensing capabilities. On the periphery of the casing are two proximately located ports 74 and 72 for inlet and outlet respectively. In the preferred embodiment the inlet port is arranged to direct fluid flow in a peripheral direction while the outlet provides a radially oriented exit. A peripheral fluid flow may be accomplished by directing the flow into the chamber in an off-center direction so circular motion will be induced. Consequently, due to the inertia of the debris passing transverse to the outlet, only the low inertia air will exit radially.

The air cleaning devices are connected to the sensing holes in the tracker bar to clean the air prior to entry to the sensing and control device. In the preferred embodiment there is provided in the sensing and control device a central vacuum draw 80 at it's lower extremity. The vacuum would be generated by any well known suction device 32. With this arrangement a vacuum draw is delivered to the tracker bar edge sensing holes through the sensing and control device and the air cleaners. Air flow is generated toward the control device and the air is cleansed between the tracker bar sensor and the control device.

Lastly, there is shown in FIGS. 1 and 3 means to provide correctional response proportional to the misalignment. More specifically, the outer edge sensing holes 21 of the tracker bar are connected to ports on the sensing and control device which are furthest from the control arm pivot, whereas the inner edge sensing holes are connected to ports closer to the pivot. In this manner there is provided increased leverage on the pendulum control arm when the pistons in the lower part act on the pendulum. Additionally, it can be seen that a correctional response from the pistons of one side will be additive and provide increased force on the pendulum as the outer edge sensing hole 21 generates a corrective response.

In operation the outer sensing holes 21 of the tracker bar will normally be uncovered and generating equal responses from their respective pistons 43. Likewise the inner sensing holes 20 would be generating equal responses in their respective pistons 42 due to equal coverage of the sensing holes 20 on the tracker bar. As the sheet from the feed roller becomes misaligned the piston responses from the inner holes becomes unequal and the equilibrium of the pistons is disturbed. Consequently, the position of the pendulum is adjusted by the pistons and the position of the plug 59 on the pneumatic valve 54 is moved proportionately.

Inasmuch as this system responds to changes in equilibrium, it is compatible with oversized sheets. In such a case the oversized sheets on the feed roller would cover the inner sensing holes on the tracker bar during operation. With the inner edge sensing holes on the tracker bar covered no air flow will exist and no response will be generated in the corresponding pistons 41. When unequal coverage occurs over the outer sensing holes an imbalance occurs in the response of pistons 42. Accordingly, an alignment response will be generated by the outer sensing holes alone and their respective pistons will accomplish the desired correctional response on the pendulum.

In conclusion it can be seen that there has been described an improved alignment system incorporating a single compact sensing and control device. A piston controlled pendulum mechanism selectively responsive to air flow is used to operate the positioning pneumatic. Accordingly, the need for multiple valves and sensing devices is eliminated, and a system is provided which will operate with oversized sheets and will provide corrective responses proportional to the degree of misalignment.

What I claim is:

1. In an automatic alignment system wherein a feed roller passes perforated sheets over an intermediate tracker bar to a take up roller, and where the tracker bar has air flow sensors disposed near it's outer edges to provide control signals to pneumatic aligning devices, the improvement which comprises:

an air flow sensing device having an outer casing member;

multiple cylindrical inlet ports disposed in spaced relation about said casing and connected to receive air flow from the sensors on the tracker bar;

pistons slidably mounted for reciprocal motion in partial sealing contact within said inlet ports for providing motion responsive to the air flow in said ports;

a control arm pivotally mounted at one extremity of said casing and depending therefrom in cam contact with said pistons to provide motion of said control arm responsive to said piston movement;

a projection from said control arm protruding external to said casing to provide external control to the aligning device corresponding to the position of said control arm.

2. The improvement of claim 1 wherein the said inlet ports connected to the sensors on a first edge of the tracker bar are disposed along a first side of the casing and the said inlet ports connected to the sensors on the second edge of the tracker bar are disposed along a second side of the casing in opposition to said first side to provide reciprocal motion of said control arm.

3. The improvement of claim 2 wherein each of said inlet ports on the first side of said casing correspond to a series of sensors on the first edge of the tracker bar, and said inlet ports on the second side correspond to a series of sensors on the second edge of the tracker bar, and wherein the sensors are linearly disposed along the tracker bar to sense increasing misalignment at each edge.

4. The improvement of claim 3 wherein said inlet ports are linearly disposed along said respective first and second sides of said casing and wherein the inlet ports corresponding to the greatest misalignment are located on the casing furthest from the control arm pivot and inlet ports corresponding to smaller misalignment located on the casing progressively closer to the control arm pivot.

5. The improvement of claim 4 wherein said projection from said control arm extends proximate an air inlet port of the pneumatic aligning device for selectively blocking the air flow and controlling the pneumatic.

6. The improvement of claim 5 wherein said projection has affixed thereto a resilient stopper for providing complete interruption of the air flow to the pneumatic aligning device.

7. The improvement of claim 6 wherein said stopper has a curved operating portion defined thereon whereby a greater portion of the inlet port is covered when the stopper undergoes deformation as it is forced against the port.

8. The improvement of claim 1 further comprising multiple fluid cleaning devices interposed said inlet ports and the tracker bar sensors comprising;

a casing having a cavity defined therein;

an inlet and an outlet port disposed on said casing in spaced relation to provide ingress and egress from said cavity;

an inlet guide affixed to said inlet port for directing fluid flow into said cavity in a peripheral direction; and an outlet guide affixed to said outlet port and radially oriented to select radial flowing fluid, whereby debris carried in the fluid will not exit the cavity.

* * * * *